US011008965B2

(12) United States Patent
Muto et al.

(10) Patent No.: US 11,008,965 B2
(45) Date of Patent: May 18, 2021

(54) CONTROL DEVICE FOR HIGH PRESSURE FUEL PUMP FOR FUEL INJECTION

(71) Applicant: TOYOTA JIDOSHA KABUSHIKI KAISHA, Toyota (JP)

(72) Inventors: Harufumi Muto, Miyoshi (JP); Naoya Okubo, Chiryu (JP); Akihiro Katayama, Toyota (JP); Yosuke Hashimoto, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/853,092

(22) Filed: Apr. 20, 2020

(65) Prior Publication Data

US 2020/0392915 A1 Dec. 17, 2020

(30) Foreign Application Priority Data

Jun. 17, 2019 (JP) ..... JP2019-112088

(51) Int. Cl.
*F02D 41/14* (2006.01)
*F02D 41/38* (2006.01)

(52) U.S. Cl.
CPC ..... *F02D 41/1405* (2013.01); *F02D 41/3845* (2013.01); *F02D 2200/023* (2013.01); *F02D 2200/0414* (2013.01); *F02D 2200/0606* (2013.01); *F02D 2200/0614* (2013.01); *F02D 2200/101* (2013.01); *F02D 2200/501* (2013.01)

(58) Field of Classification Search
CPC .. F02D 41/14; F02D 41/1405; F02D 41/3845; F02D 2200/023; F02D 2200/0414; F02D 2200/0606; F02D 2200/614; F02D 2200/101; F02D 2200/501
See application file for complete search history.

(56) References Cited

U.S. PATENT DOCUMENTS

2004/0099252 A1 5/2004 Nagaishi et al.
2009/0177372 A1 7/2009 Akita et al.
2015/0128683 A1 5/2015 Kumano et al.

FOREIGN PATENT DOCUMENTS

JP 2004-137953 A 5/2004
JP 2007-32525 A 2/2007
JP 2007-285128 A 11/2007
(Continued)

*Primary Examiner* — Hieu T Vo
(74) *Attorney, Agent, or Firm* — Oblon, McClelland, Maier & Neustadt, L.L.P.

(57) ABSTRACT

A control device for a high pressure fuel pump (33) for fuel injection (14) in which values of at least seven parameters of an engine speed, an engine load, a lubrication oil temperature, an amount of fuel supplied to the high pressure fuel pump (33), a temperature of intake air fed into the engine, a temperature of fuel discharged from the high pressure fuel pump (33), and a vehicle speed are acquired, and a learned neural network learned in weights using acquired values of the seven parameters as input values of the neural network and using as training data the temperature of fuel discharged from the high pressure fuel pump (33) acquired after a fixed time period from when acquiring the values of the seven parameters is stored, At the time of an engine operation, the temperature of fuel discharged from the high pressure fuel pump (33) after the fixed time period is estimated by using the learned neural network from the current estimated temperature of fuel discharged from the high pressure fuel pump (33).

3 Claims, 12 Drawing Sheets

(56) References Cited

FOREIGN PATENT DOCUMENTS

| | | | |
|---|---|---|---|
| JP | 2013-227921 | A | 11/2013 |
| JP | 2015-59494 | A | 3/2015 |
| JP | 2017-172384 | A | 9/2017 |

FIG. 9

| | | INPUT PARAMETER |
|---|---|---|
| ESSENTIAL | HEAT GENERATING FACTOR | ENGINE SPEED |
| | HEATING FACTOR | ENGINE LOAD |
| | | LUBRICATION OIL TEMPERATURE |
| | COOLING FACTOR | AMOUNT OF FUEL SUPPLIED |
| | HEAT DISCHARGING FACTOR | TEMPERATURE OF INTAKE AIR |
| | | VEHICLE SPEED |
| | | FUEL TEMPERATURE TF |
| AUXILIARY | HEAT GENERATING FACTOR | IGNITION TIMING |
| | | EGR RATE |
| | | VALVE TIMING |
| | | COOLING WATER TEMPERATURE |
| | | AIR-CONDITIONER OPERATION |
| | COOLING FACTOR | ELECTRIC COOLING FAN |
| | | WEATHER CONDITIONS |

FIG. 10

| No. | $x_1$ | $x_2$ | • • • • • • • • • • • | $x_{n-1}$ | $x_n$ | $y_t$ |
|---|---|---|---|---|---|---|
| 1 | $x_{11}$ | $x_{21}$ | • • • • • • • • • • • | $x_{n-11}$ | $x_{n1}$ | $y_{t1}$ |
| 2 | $x_{12}$ | $x_{22}$ | • • • • • • • • • • • | $x_{n-12}$ | $x_{n2}$ | $y_{t2}$ |
| ⋮ | ⋮ | ⋮ | ⋮ | ⋮ | ⋮ | ⋮ |
| m−1 | $x_{1m-1}$ | $x_{2m-1}$ | • • • • • • • • • • • | $x_{n-1m-1}$ | $x_{nm-1}$ | $y_{tm-1}$ |
| m | $x_{1m}$ | $x_{2m}$ | • • • • • • • • • • • | $x_{n-1m}$ | $x_{nm}$ | $y_{tm}$ |

CONTROL DEVICE FOR HIGH PRESSURE FUEL PUMP FOR FUEL INJECTION

FIELD

The present invention relates to a control device for a high pressure fuel pump for fuel injection.

BACKGROUND

In fuel, there is a vapor generating region in which fuel vapor is generated inside the fuel. In this case, whether fuel vapor is generated inside the fuel is determined from the fuel temperature and fuel pressure. If the fuel temperature exceeds a certain temperature determined from the fuel pressure, fuel vapor will be generated inside the fuel. If fuel vapor is generated inside the fuel, at the time of engine startup, the fuel pressure will not easily rise even if operating a high pressure fuel pump for fuel injection, and a long time will be required until the fuel pressure reaches the target fuel pressure. On the other hand, a high pressure fuel distribution pipe for distributing fuel discharged from the high pressure fuel pump to fuel injectors usually is not equipped with a fuel temperature sensor for detecting the fuel temperature, but is equipped with a fuel pressure sensor for detecting the fuel pressure. Further, the engine body is usually equipped with a water temperature sensor for detecting an engine cooling water temperature.

Therefore, known in the art is an internal combustion engine where the engine cooling water temperature is used in place of the fuel temperature and if there is request for startup of the engine, the state of generation of fuel vapor is estimated from the results of detection of the fuel pressure sensor and the water temperature sensor, the operation of the high pressure fuel pump is made to start before starting up the engine when it is estimated that fuel vapor is being generated, and the greater the estimated amount of generation of fuel vapor, the longer the operating time of the high pressure fuel pump before engine startup is made (for example see Japanese Unexamined Patent Publication No. 2007-285128).

SUMMARY

However, there is a temperature difference between the engine cooling water temperature and the fuel temperature. In particular, when a vehicle is running, the temperature difference between the water temperature and the fuel temperature greatly changes in accordance with the operating state of the engine. Therefore, even if using the engine cooling water temperature in place of the fuel temperature and estimating the state of generation of fuel vapor from the results of detection of the fuel pressure sensor and the water temperature sensor, it is difficult to precisely estimate the state of generation of fuel vapor. In this case, to precisely judge if fuel vapor is being generated, it is necessary to precisely estimate the fuel temperature.

In the present invention, there is provided a control device for high pressure fuel pump for fuel injection which uses a neural network to precisely estimate the fuel temperature and thereby enables the pressure of fuel injected from a fuel injector to be controlled so that fuel vapor is not generated.

That is, according to the present invention, there is provided a control device for a high pressure fuel pump for fuel injection driven by an engine to supply fuel to a fuel injector, wherein values of at least seven parameters of an engine speed, an engine load, a lubrication oil temperature, an amount of fuel supplied to the high pressure fuel pump, a temperature of intake air fed into the engine, a temperature of fuel discharged from the high pressure fuel pump, and a vehicle speed are acquired, a learned neural network learned in weights using acquired values of the seven parameters as input values of the neural network and using as training data a temperature of fuel discharged from the high pressure fuel pump acquired after a fixed time period from when acquiring the values of the seven parameters is stored, at the time of an engine operation, the temperature of fuel discharged from the high pressure fuel pump after the fixed time period is estimated by using the learned neural network from a current engine speed, a current engine load, a current lubrication oil temperature, a current amount of fuel supplied to the high pressure fuel pump, a current temperature of intake air fed into the engine, a current temperature of fuel discharged from the high pressure fuel pump, and a current vehicle speed, wherein actually measured values are used for the current engine speed, the current engine load, the current lubrication oil temperature, the current amount of fuel supplied to the high pressure fuel pump, the current temperature of intake air fed into the engine, and the current vehicle speed and an estimated value estimated using the learned neural network is used for the current temperature of fuel discharged from the high pressure fuel pump and a pressure of fuel injected from the fuel injector is controlled based on the estimated value of the temperature of the fuel discharged from the high pressure fuel pump after the fixed time period which is estimated using the learned neural network.

According to the present invention, it is possible to use a neural network to precisely estimate a temperature of fuel discharged from a high pressure fuel pump and thereby possible to control a pressure of fuel injected from a fuel injector so that no fuel vapor is generated.

BRIEF DESCRIPTION OF DRAWINGS

FIG. 9 is a view showing a list of input parameters.

FIG. 10 is a view showing a training data set.

DESCRIPTION OF EMBODIMENTS

Overall Configuration of Internal Combustion Engine

Figure 1:
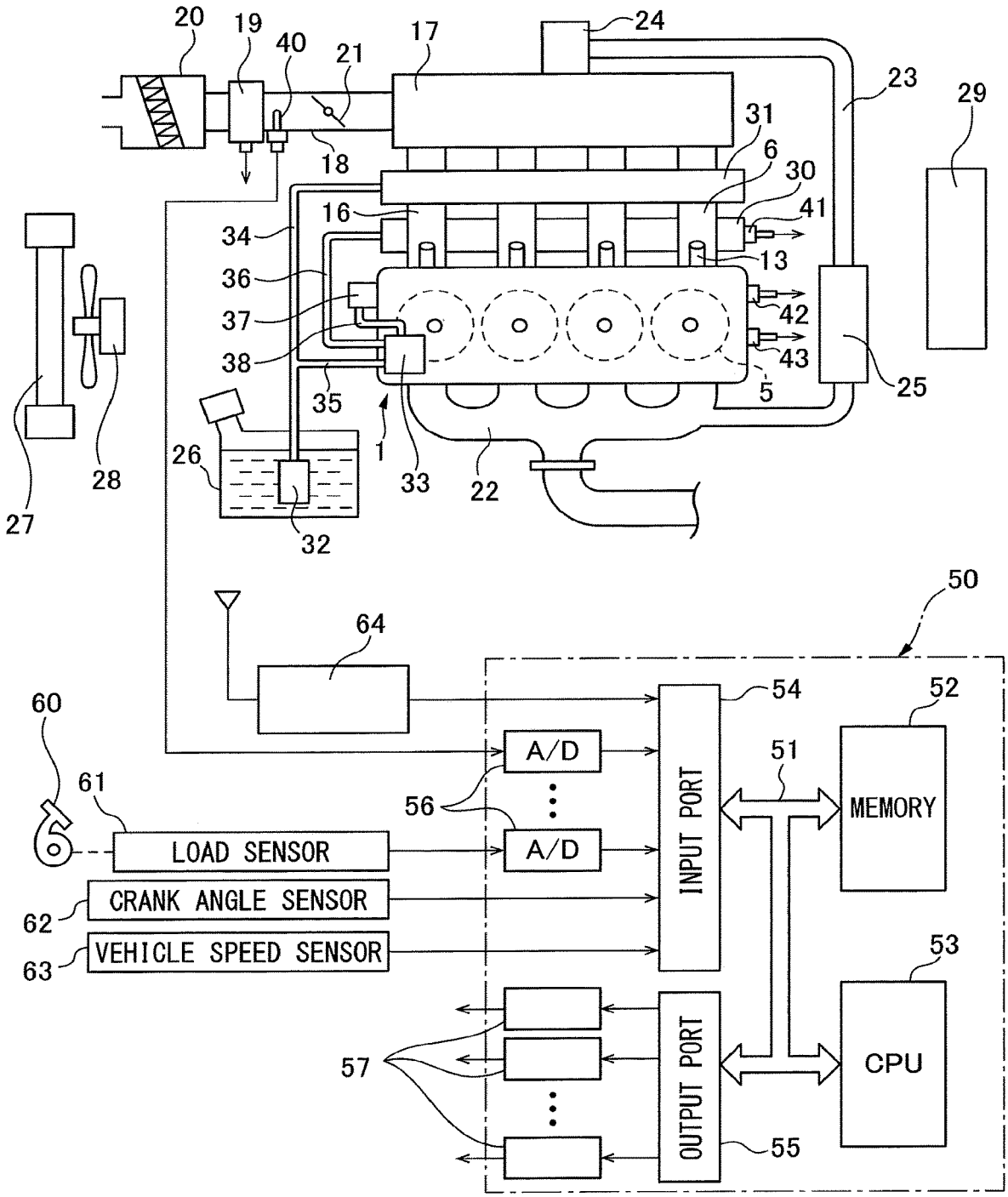
FIG. 1 is an overall view of an internal combustion engine.
Figure 2:
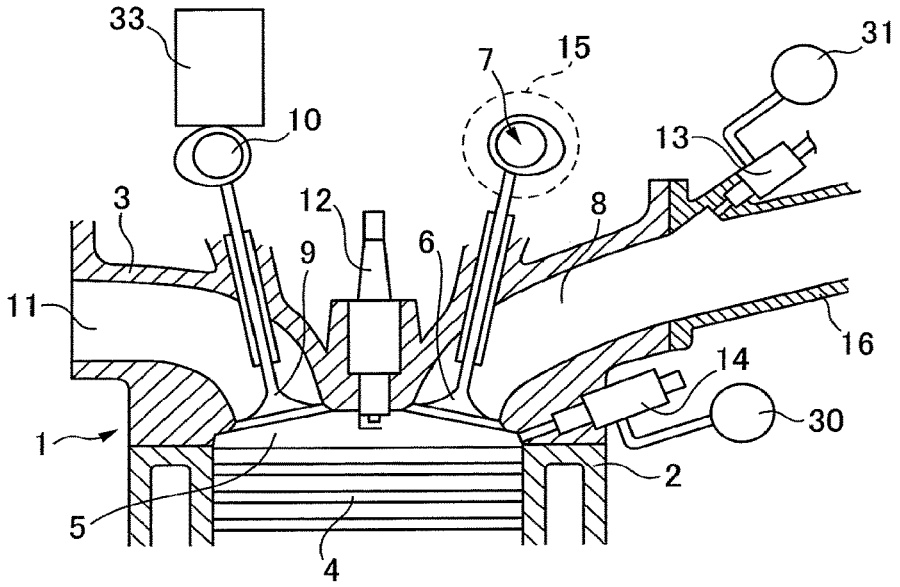
FIG. 2 is a cross-sectional side view of the internal combustion engine shown in FIG. 1.

FIG. 1 shows an overall view of an internal combustion engine. FIG. 2 shows a cross-sectional side view of the internal combustion engine. Referring to FIG. 2, 1 indicates an engine body, 2 a cylinder block, 3 a cylinder head, 4 a piston reciprocating inside the cylinder block 2, 5 a combustion chamber, 6 an intake valve, 7 an intake valve use cam shaft driven by the engine, 8 an intake port, 9 an exhaust valve, 10 an exhaust valve use cam shaft driven by the engine, 11 an exhaust port, 12 a spark plug arranged in the combustion chamber 5, 13 a fuel injector for supplying the inside of the intake port 8 with fuel, for example, gasoline, 14 a fuel injector for supplying the inside of the combustion chamber 5 with fuel, for example, gasoline, and 15 a variable valve timing mechanism for controlling the opening timing of the intake valve 6.

If referring to FIG. 1 and FIG. 2, the intake port 8 is connected through a respectively corresponding intake branch pipe 16 to a surge tank 17, while the surge tank 17 is connected through an intake duct 18 and an intake air amount detector 19 to an air cleaner 20. Inside the intake duct 18, a throttle valve 21 is arranged. On the other hand, the exhaust port 11 is connected to an exhaust manifold 22, while the exhaust manifold 22 is connected through an exhaust gas recirculation (below, referred to as "EGR") passage 23 and an EGR control valve 24 to the surge tank 17. Inside the EGR passage 23, an EGR cooler 25 is arranged for cooling the EGR gas. Note that, in FIG. 1, 26 shows a fuel tank, 27 shows a radiator, 28 shows an electric cooling fan of the radiator 27, and 29 shows an air-conditioner for cabin use.

As shown in FIG. 1 and FIG. 2, the fuel injector 13 is connected to a low pressure fuel distribution pipe 31 for distributing low pressure fuel to the fuel injectors 13, while the fuel injector 14 is connected to a high pressure fuel distribution pipe 30 for distributing high pressure fuel to the fuel injectors 14. On the other hand, inside the fuel tank 26, a low pressure fuel pump 32 is arranged. On the cylinder head 3 of the engine body 1, a high pressure fuel pump 33 is arranged. As shown in FIG. 1, the fuel inside the fuel tank 26 is connected by the low pressure fuel pump 32 on the one hand through a fuel feed pipe 34 to the low pressure fuel distribution pipe 31 and on the other hand through a fuel feed pipe 35 branched from the fuel feed pipe 34 to the high pressure fuel pump 33. The high pressure fuel discharged from the high pressure fuel pump 33 is fed through a fuel feed pipe 36 to the high pressure fuel distribution pipe 30.

Further, as shown in FIG. 1, the engine body 1 is equipped with an oil pump 37 driven by the engine. Lubrication oil inside the engine body 1 is supplied by the oil pump 37 through an oil feed pipe 38 to the high pressure fuel pump 33. Further, as shown in FIG. 1, inside the intake duct 18, an intake air temperature sensor 40 is arranged for detecting the intake air temperature. Inside the high pressure fuel distribution pipe 30, a fuel pressure sensor 41 for detecting the fuel pressure inside the high pressure fuel distribution pipe 30 is arranged. The engine body 1 is equipped with a water temperature sensor 42 for detecting an engine cooling water temperature and a lubrication oil temperature sensor 43 for detecting a lubrication oil temperature.

On the other hand, in FIG. 1, 50 shows an electronic control unit for controlling operation of the engine. As shown in FIG. 1, the electronic control unit 50 is comprised of a digital computer provided with a storage device 52, that is, a memory 52, a CPU (microprocessor) 53, an input port 54, and an output port 55, which are connected with each other by a bidirectional bus 51. The output signal of the intake air amount detector 19, the output signal of the intake air temperature sensor 40, the output signal of the fuel pressure sensor 41, the output signal of the water temperature sensor 42, and the output signal of the lubrication oil temperature sensor 43 are input to the input port 54 through the respectively corresponding AD converters 56.

Further, at the accelerator pedal 60, a load sensor 61 generating an output voltage proportional to the amount of depression of the accelerator pedal 60 is connected. The output voltage of the load sensor 61 is input through the corresponding AD converter 56 to the input port 54. Furthermore, at the input port 54, a crank angle sensor 62 generating an output pulse every time a crankshaft rotates by for example 30° is connected. Inside the CPU 53, the engine speed is calculated based on the output signal of the crank angle sensor 62. Further, at the input port 54, a vehicle speed sensor 63 generating an output pulse proportional to the vehicle speed is connected. Further, a receiving device 64 is provided for receiving information relating to weather. The information relating to weather received at the receiving device 64 is input to the input port 54.

On the other hand, the output port 55 is connected through corresponding drive circuits 57 to the spark plug 12 of each cylinder, fuel injectors 13 and 14 of each cylinder, variable valve timing mechanism 15, EGR control valve 24, electric cooling fan 28, air-conditioner 29, low pressure fuel pump 32, and high pressure fuel pump 33.

Figure 3:
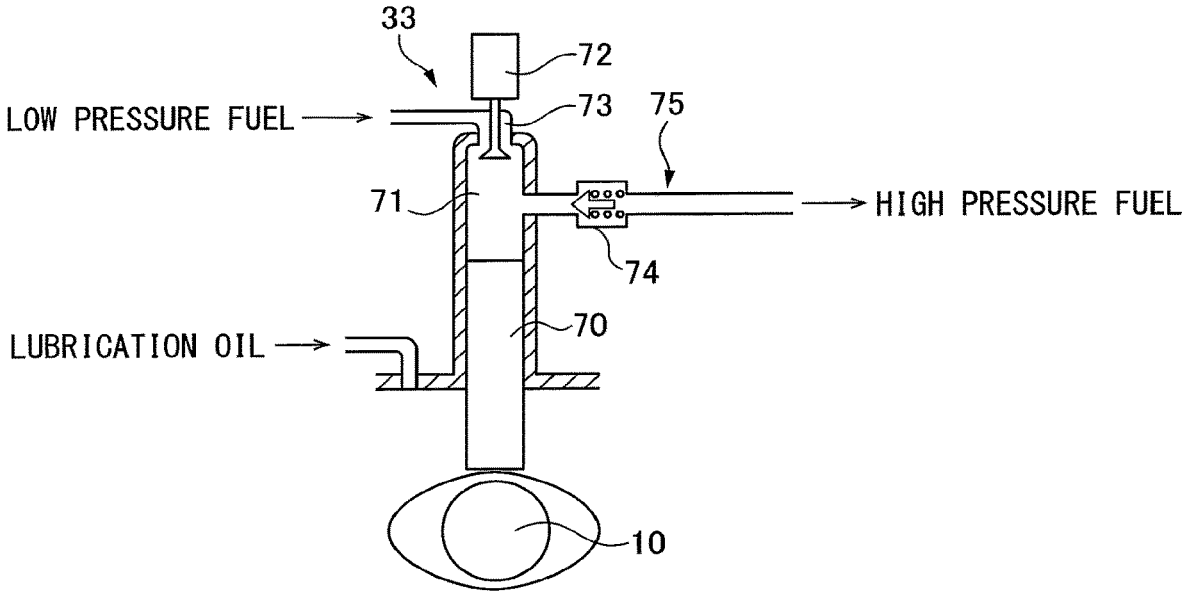
FIG. 3 is a cross-sectional side view schematically showing a high pressure fuel pump.

FIG. 3 shows a cross-sectional side view schematically illustrating the high pressure fuel pump 33. Referring to FIG. 3, 70 indicates a pump plunger, 71 a pressurizing chamber filled with fuel, and 72 an electromagnetic type spill valve performing the work of opening and closing an inlet opening 73. In the example shown in FIG. 3, the pump plunger 70 is made to reciprocate up and down at all times during engine operation by a cam formed on the exhaust valve use camshaft 10, and lubrication oil is supplied to the inside of the high pressure fuel pump 33 from the lubrication oil feed pipe 38. In FIG. 3, when the pump plunger 70 is descending, the electromagnetic type spill valve 72 is opened. At this time, low pressure fuel discharged from the low pressure fuel pump 32 is supplied through the inlet opening 73 to the inside of the pressurizing chamber 71.

On the other hand, when the pump plunger 70 is rising, the electromagnetic type spill valve 72 is temporarily made to close during the rise of the pump plunger 70. If the electromagnetic type spill valve 72 is made to close while the pump plunger 70 is rising, the fuel inside the pressurizing chamber 71 is pressurized. If the fuel pressure inside the pressurizing chamber 71 becomes higher than the fuel pressure inside the high pressure fuel distribution pipe 30, the high pressure fuel inside the pressurizing chamber 71 is sent from the pressurizing chamber 71 to the high pressure fuel distribution pipe 30 through a check valve 74 enabling flow only toward the high pressure fuel distribution pipe 30. At this time, the amount of high pressure fuel sent into the high pressure fuel distribution pipe 30 depends on the time during which the electromagnetic type spill valve 72 is made to close while the pump plunger 70 is rising. Therefore, by controlling the closing time of the electromagnetic type spill valve 72, it becomes possible to freely control the fuel pressure inside the high pressure fuel distribution pipe 30. Note that, when the injection of fuel from the fuel injector 14 is stopped, the electromagnetic type spill valve 72 is held in the open state. At this time, the action of sending high pressure fuel to the high pressure fuel distribution pipe 30 is stopped.

Figure 4:
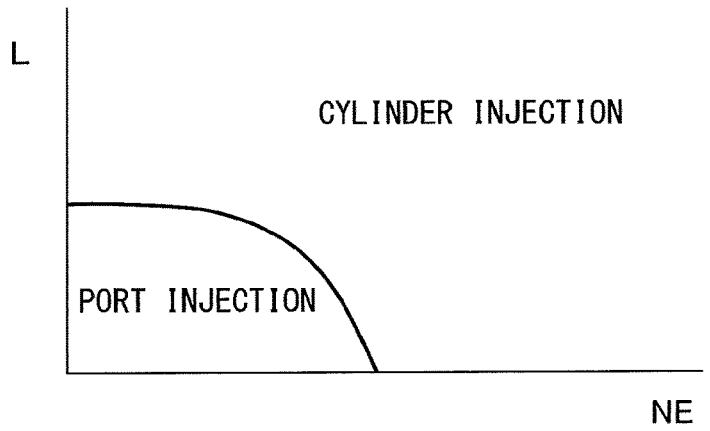
FIG. 4 is a view showing a cylinder injection region and a port injection region.

In the embodiment of the present invention, port injection injecting fuel from the fuel injector 13 to inside the intake port 8 and cylinder injection injecting fuel from the fuel injector 14 to inside the combustion chamber 5 are performed. FIG. 4 shows one example of the operating regions where these port injection and cylinder injection are performed. Note that, in FIG. 4, the ordinate L shows the engine load, while the abscissa NE shows the engine load. As shown in FIG. 4, in this example, the port injection is performed at the time of engine low load and low speed operation, while the cylinder injection is performed at the time of engine high load operation or engine high speed operation.

Figure 5:
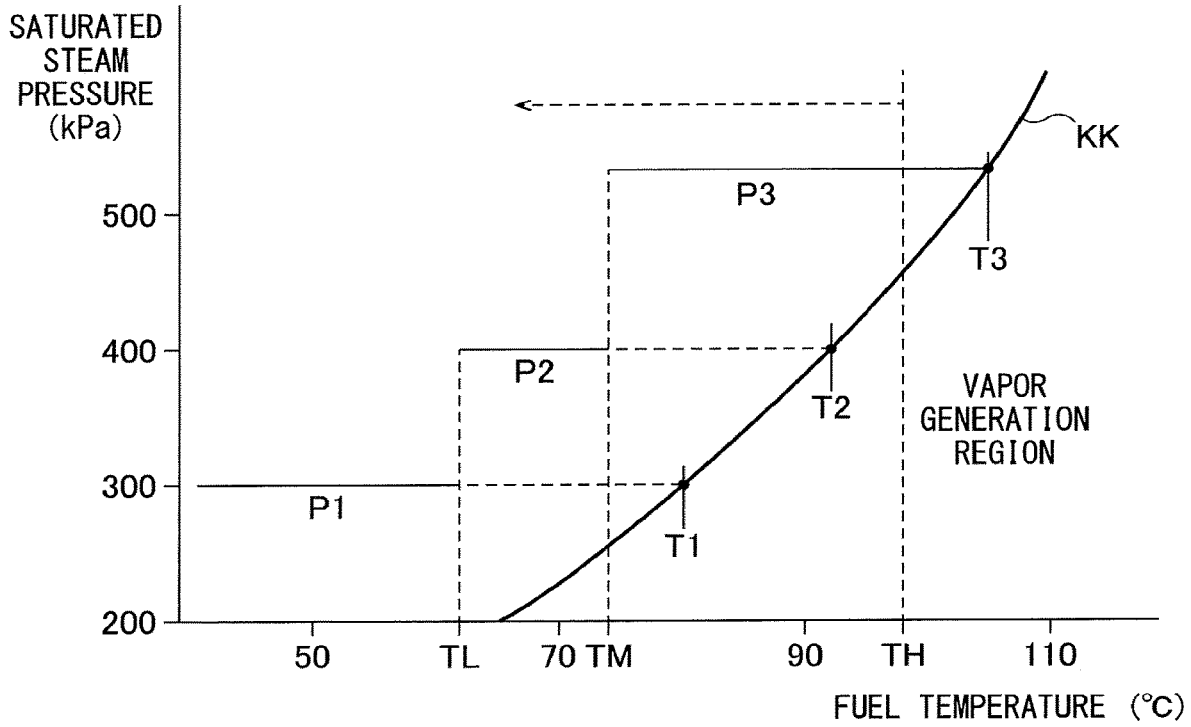
FIG. 5 is a view showing a steam pressure curve KK.

FIG. 5 shows a steam pressure curve KK of fuel used in the embodiment according to the present invention. Note that, in FIG. 5, the ordinate shows the saturated steam pressure (kPa) while the abscissa shows the fuel temperature (° C.). In this FIG. 5, the region above the steam pressure curve KK shows the region where vapor is not generated inside the fuel, while the region below the steam pressure curve KK shows the vapor generating region where fuel vapor is generated inside the fuel. Therefore, for example, in FIG. 5, when the fuel pressure is P1 (300 kPa), if the temperature of the fuel is lower than T1 (about 80° C.), no fuel vapor is generated inside the fuel, while if the temperature of the fuel is over T1, fuel vapor is generated inside the fuel. Similarly, when the fuel pressure is P2 (400 kPa), if the temperature of the fuel is over T2, fuel vapor is generated inside the fuel while when the fuel pressure is P3 (530 kPa), if the temperature of the fuel is over T3, fuel vapor is generated inside the fuel.

In this regard, in the low pressure fuel pump 32, the temperature of the fuel will not rise that much. Therefore, no fuel vapor will be generated in the fuel inside the fuel feed pipe 34 and the low pressure fuel distribution pipe 31. As opposed to this, inside the high pressure fuel pump 33, the temperature of the fuel becomes higher due to the pressurizing action of fuel by the pump plunger 70. As a result, there is a danger of generation of fuel vapor inside fuel pressurized by the high pressure fuel pump 33. In this case, the fuel vapor is first generated inside the pressurized fuel of the highest temperature in the pressurized fuel present in the high pressure fuel feed system comprised of the high pressure fuel pump 33, fuel feed pipe 36, and high pressure fuel distribution pipe 30. Therefore, whether or not fuel vapor is generated is governed by the temperature of the pressurized fuel of the highest temperature in the pressurized fuel present inside the high pressure fuel feed system.

In this regard, the pressurized fuel becoming highest in temperature in the pressurized fuel present inside the high pressure fuel feed system is the pressurized fuel right after being discharged from the pressurizing chamber 71 to the high pressure fuel distribution pipe 30, for example, the pressurized fuel which flows near the position shown by the arrow 75 in FIG. 3 and is the pressurized fuel right after passing through the check valve 74. Therefore, whether fuel vapor has been generated is governed by the temperature of the pressurized fuel right after being discharged from the pressurizing chamber 71 toward the high pressure fuel distribution pipe 30. Note that, in the embodiment according to the present invention, below, the temperature of the pressurized fuel right after being discharged from the pressurizing chamber 71 toward the high pressure fuel distribution pipe 30 will be called the "temperature TF of fuel discharged from the high pressure fuel pump 33". Therefore, in the embodiment according to the present invention, whether or not fuel vapor is generated depends on the temperature TF of fuel discharged from the high pressure fuel pump 33.

Now then, if fuel vapor is generated in the high pressure fuel feed system, the amount of fuel injected from the fuel injector 14 will greatly deviate from the demanded injection amount and normal fuel injection control will become impossible. Therefore, it is necessary to avoid the generation of fuel vapor in the high pressure fuel feed system. Therefore, in the embodiment according to the present invention, to prevent fuel vapor from being generated, as shown in FIG. 5, the target injection pressure of the fuel injector 14, that is, the target fuel pressure inside the high pressure fuel distribution pipe 30, is made to gradually change from P1 to P2 and then to P3 gradually as the temperature TF of fuel discharged from the high pressure fuel pump 33 becomes higher. Note that, in this case, the abscissa of FIG. 5 shows the temperature TF of fuel discharged from the high pressure fuel pump 33.

In this regard, if the target fuel pressure inside the high pressure fuel distribution pipe 30 becomes higher, the drive energy of the high pressure fuel pump 33 will increase, so the fuel consumption will increases. Therefore, the target fuel pressure inside the high pressure fuel distribution pipe 30 is preferably made as low as possible to the possible extent, that is, in the example shown in FIG. 5, it is preferably maintained at P1. However, if maintaining the target fuel pressure inside the high pressure fuel distribution pipe 30 at P1, when the temperature TF of fuel discharged from the high pressure fuel pump 33 rises, fuel vapor is generated. Therefore, to avoid the generation of fuel vapor, in the example shown in FIG. 5, if the temperature TF of fuel discharged from the high pressure fuel pump 33 exceeds the set value TL, the target fuel pressure inside the high pressure fuel distribution pipe 30 is raised from P1 to P2, and the temperature TF of fuel discharged from the high pressure fuel pump 33 exceeds the set value TM, the target fuel pressure inside the high pressure fuel distribution pipe 30 is raised from P2 to P3.

On the other hand, in FIG. 5, when the target fuel pressure inside the high pressure fuel distribution pipe 30 is P3, if fuel is being injected from the fuel injector 14, that is, if the cylinder injection is being performed, the high pressure fuel pump 33 continues being cooled by the low temperature fuel flowing into the high pressure fuel pump 33. As a result, the temperature TF of fuel discharged from the high pressure fuel pump 33 will never exceed the vapor generating temperature T3 shown in FIG. 3. However, if the injection mode changes from the cylinder injection to the port injection, the cooling action of the high pressure fuel pump 33 by the low temperature fuel is no longer performed, so there is the danger that due to some reason or another, the fuel temperature inside the high pressure fuel feed system will rise and thereby fuel vapor will be generated in the fuel in the high pressure fuel feed system.

Therefore, in the embodiment of the present invention, when the port injection is being performed, when the temperature TF of fuel discharged from the high pressure fuel pump 33 exceeds the set value TH shown in FIG. 5, the port injection is switched to the cylinder injection. Thereby, the fuel temperature inside the high pressure fuel feed system is caused to fall due to the cooling action of the high pressure fuel pump 33 by the low temperature fuel. In this case, in the example shown in FIG. 5, the cylinder injection is performed until the temperature TF of fuel discharged from the high pressure fuel pump 33 for example falls to an intermediate temperature of the set value TL and the set value TM from the set value TH as shown by the broken line arrow.

Now then, as explained above, to improve the fuel consumption, it is necessary to maintain the target fuel pressure inside the high pressure fuel distribution pipe 30 at as low a pressure as possible. For this reason, in FIG. 5, the set value TL and the set value TM respectively have to be made to approach T1 and T2 as much as possible. However, if the set value TL and the set value TM are respectively made to approach T1 and T2 as much as possible, unless the accurate value of the temperature TF of fuel discharged from the high pressure fuel pump 33 is known, there is the danger of fuel vapor ending up being generated. That is, to prevent fuel vapor from being generated while making the set value TL and the set value TM respectively approach T1 and T2, it is necessary to acquire the accurate value of the temperature TF of fuel discharged from the high pressure fuel pump 33.

In this regard, however, usually, due to cost issues, no fuel temperature sensor is provided for detecting the temperature TF of fuel discharged from the high pressure fuel pump 33. As the temperature TF of fuel discharged from the high pressure fuel pump 33, for example, the intake air temperature detected by the intake air temperature sensor is used instead. However, there is a large temperature difference between the intake air temperature and the temperature TF of fuel discharged from the high pressure fuel pump 33. Therefore, at the current time, the set value TL is set to a considerably small value compared with T1 and the set value TM is set to a considerably small value compared with T2 so that no fuel vapor is generated even if the temperature difference between the intake air temperature and the temperature TF of fuel discharged from the high pressure fuel pump 33 becomes large.

However, so long as controlling the fuel pressure inside the high pressure fuel distribution pipe 30 to the target fuel pressure without acquiring an accurate value of the temperature TF of fuel discharged from the high pressure fuel pump 33 in this way, it is not possible to improve the fuel consumption. Therefore, in an embodiment of the present invention, a neural network is used to accurately estimate the temperature TF of fuel discharged from the high pressure fuel pump 33 and thereby improve the fuel consumption.

Summary of Neural Network

Figure 6:
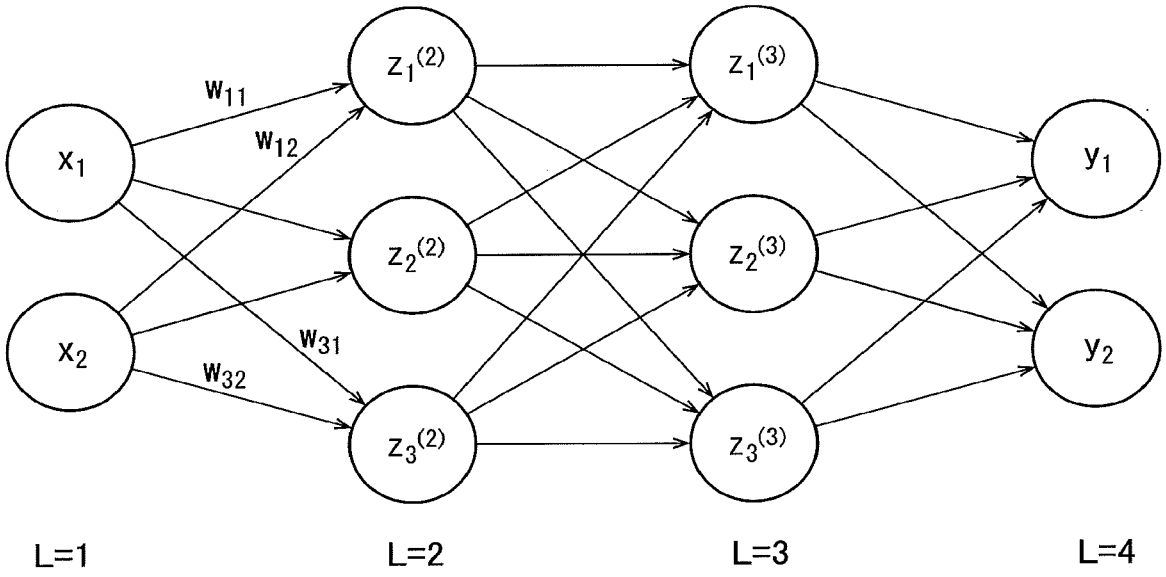
FIG. 6 is a view showing one example of a neural network.

As explained above, in the embodiment according to the present invention, a neural network is used to estimate the temperature TF of the discharge fuel from the high pressure fuel pump 33. Therefore, first, a neural network will be briefly explained. FIG. 6 shows a simple neural network. The circle marks in FIG. 6 show artificial neurons. In the neural network, these artificial neurons are usually called "nodes" or "units" (in the present application, they are called "nodes"). In FIG. 6, L=1 shows an input layer, L=2 and L=3 show hidden layers, and L=4 shows an output layer. Further, in FIG. 6, $x_1$ and $x_2$ show output values from nodes of the input layer (L=1), $y_1$ and $y_2$ show output values from the nodes of the output layer (L=4), $z^{(2)}{}_1$, $z^{(2)}{}_2$, and $z^{(2)}{}_3$ show output values from the nodes of one hidden layer (L=2), and $z^{(3)}{}_1$, $z^{(3)}{}_2$, and $z^{(3)}{}_3$ show output values from the nodes of another hidden layer (L=3). Note that, the numbers of hidden layers may be made one or any other numbers, while the number of nodes of the input layer and the numbers of nodes of the hidden layers may also be made any numbers. Further, the number of nodes of the output layer may be made a single node, but may also be made a plurality of nodes.

At the nodes of the input layer, the inputs are output as they are. On the other hand, the output values $x_1$ and $x_2$ of the nodes of the input layer are input at the nodes of the hidden layer (L=2), while the respectively corresponding weights "w" and biases "b" are used to calculate sum input values "u" at the nodes of the hidden layer (L=2). For example, a sum input value $u_k$ calculated at a node shown by $z^{(2)}{}_k$ (k=1, 2, 3) of the hidden layer (L=2) in FIG. 6 becomes as shown in the following equation:

$$U_k = \sum_{m=1}^{u} (x_m \cdot w_{km}) + b_k$$

Next, this sum input value $u_k$ is converted by an activation function "f" and is output from a node shown by $z^{(2)}{}_k$ of the hidden layer (L=2) as an output value $z^{(2)}k$ (=$f(u_k)$). On the other hand, the nodes of the hidden layer (L=3) receive as input the output values $z^{(2)}{}_1$, $z^{(2)}{}_2$, and $z^{(2)}{}_3$ of the nodes of the hidden layer (L=2). At the nodes of the hidden layer (L=3), the respectively corresponding weights "w" and biases "b" are used to calculate the sum input values "u" ($\Sigma z \cdot w+b$). The sum input values "u" are similarly converted by an activation function and output from the nodes of the hidden layer (L=3) as the output values $z^{(3)}{}_1$, $z^{(3)}{}_2$, and $z^{(3)}{}_3$. As this activation function, for example, a Sigmoid function $\sigma$ is used.

On the other hand, at the nodes of the output layer (L=4), the output values $z^{(3)}{}_1$, $z^{(3)}{}_2$, and $z^{(3)}{}_3$ of the nodes of the hidden layer (L=3) are input. At the nodes of the output layer, the respectively corresponding weights "w" and biases "b" are used to calculate the sum input values "u" ($\Sigma z \cdot w+b$) or just the respectively corresponding weights "w" are used to calculate the sum input values "u" ($\Sigma z \cdot w$). In the embodiment according to the present invention, at the nodes of the output layer, an identity function is used, therefore, from the nodes of the output layer, the sum input values "u" calculated at the nodes of the output layer are output as they are as the output values "y".

Learning in Neural Network

Now then, if designating the training data showing the truth values of the output values "y" of the neural network as $y_t$, the weights "w" and biases "b" in the neural network are learned using the error backpropagation algorithm so that the difference between the output values "y" and the training data $y_t$ becomes smaller. This error backpropagation algorithm is known. Therefore, the error backpropagation algorithm will be explained simply below in its outlines. Note that, a bias "b" is one kind of weight "w", so below, a bias "h" will be also be included in what is referred to as a weight "w". Now then, in the neural network such as shown in FIG. 6, if the weights at the input values $u^{(L)}$ to the nodes of the layers of L=2, L=3, or L=4 are expressed by $w^{(L)}$, the differential due to the weights $w^{(L)}$ of the error function E, that is, the slope $\partial E/\partial w^{(L)}$, can be rewritten as shown in the following equation:

$$\partial E/\partial w^{(L)} = (\partial E/\partial u^{(L)})(\partial u^{(L)}/\partial w^{(L)}) \quad (1)$$

where, $z^{(L-1)} \cdot \partial w^{(L)} = \partial u^{(L)}$, so if $(\partial E/\partial u^{(L)}) = \delta^{(L)}$, the above equation (1) can be shown by the following equation:

$$\partial E/\partial w^{(L)} = \delta^{(L)} \cdot z^{(L-1)} \quad (2)$$

where, if $u^{(L)}$ fluctuates, fluctuation of the error function F is caused through the change in the sum input value $u^{(L+1)}$ of the following layer, so $\delta^{(L)}$ can be expressed by the following equation:

$$\delta^{(L)} = (\partial E/\partial u^{(L)}) = \sum_{k=1}^{k} (\partial E/\partial u_k^{(L+1)})(\partial u_k^{(L+1)}/\partial u^{(L)})(k = 1, 2 \ldots) \tag{3}$$

where, if expressing $z^{(L)}=f(u^{(L)})$, the input value $u_k^{(L+1)}$ appearing at the right side of the above equation (3) can be expressed by the following formula:

$$\text{input value } u_k^{(L+1)} = \sum_{k=1}^{k} w_k^{(L+1)} \cdot z^{(L)} = \sum_{k=1}^{k} w_k^{(L+1)} \cdot f(u^{(L)}) \tag{4}$$

where, the first term $(\partial E/\partial u^{(L+1)})$ at the right side of the above equation (3) is $\delta^{(L+1)}$, and the second term $(\partial u_k^{(L+1)}/\partial u^{(L)})$ at the right side of the above equation (3) can be expressed by the following equation:

$$\partial(w_k^{(L+1)} \cdot z^{(L)})/\partial u^{(L)} = w_k^{(L+1)} \cdot \partial f(u^{(L)})/\partial u^{(L)} = w_k^{(L+1)} \cdot f'(u^{(L)}) \tag{5}$$

Therefore, $\delta^{(L)}$ is shown by the following formula.

$$\delta^{(L)} = \sum_{k=1}^{k} w_k^{(L+1)} \cdot \delta^{(L+1)} \cdot f'(u^{(L)})$$

That is, $$\delta^{(L-1)} = \sum_{k=1}^{k} w_k^{(L)} \cdot \delta^{(L)} \cdot f'(u^{(L-1)}) \tag{6}$$

That is, if $\delta^{(L+1)}$ is found, it is possible to find $\delta^{(L)}$.

Now then, when there is a single node of the output layer (L=4), training data $y_t$ is found for a certain input value, and the output values from the output layer corresponding to this input value are "y", if the square error is used as the error function, the square error E is found by $E=\frac{1}{2}(y-y_t)^2$. In this case, at the node of the output layer (L=4), the output values "y" become $f(u^{(L)})$, therefore, in this case, the value of $\delta^{(L)}$ at the node of the output layer (L=4) becomes like in the following equation:

$$\delta^{(L)} = \partial E/\partial u^{(L)} = (\partial E/\partial y)(\partial y/\partial u^{(L)}) = (y-y_t) \cdot f'(u^{(L)}) \tag{7}$$

In this case, in the embodiments of the present invention, as explained above, $f(u^{(L)})$ is an identity function and $f(u^{(L1)})=1$. Therefore, this leads to $\delta(L)=y-y_t$ and $\delta^{(L)}$ is found.

If $\delta^{(L)}$ is found, the above equation (6) is used to find the $\delta^{(L-1)}$ of the previous layer. The δ's of the previous layer are successively found in this way. Using these values of δ's, from the above equation (2), the differential of the error function E, that is, the slope $\partial E/\partial w^{(L)}$, is found for the weights "w". If the slope $\partial E/\partial w^{(L)}$ is found, this slope $\partial E/\partial w^{(L)}$ is used to update the weights "w" so that the value of the error function E decreases. That is, the values of the weights "w" are learned. Note that, as shown in FIG. 6, when the output layer (L=4) has a plurality of nodes, if making the output values from the nodes $y_1$, $y_2$ . . . and making the corresponding training data $y_{t1}$, $y_{t2}$ . . . , as the error function E, the following square sum error E is used:

$$\text{Square sum error } E = \frac{1}{2}\sum_{k=1}^{n} (y_k - y_{tk})^2 \tag{8}$$

("n" is number of nodes output layer)

In this case as well, the values of $\delta^{(L)}$ at the nodes of the output layer (L=4) become $\delta^{(L)}=y-y_t k$ (k=1, 2 . . . n). From the values of these $\delta^{(L)}$, the above formula (6) is used to find the $\delta^{(L-1)}$ of the previous layers.

Embodiment of Present Invention

Figure 7:
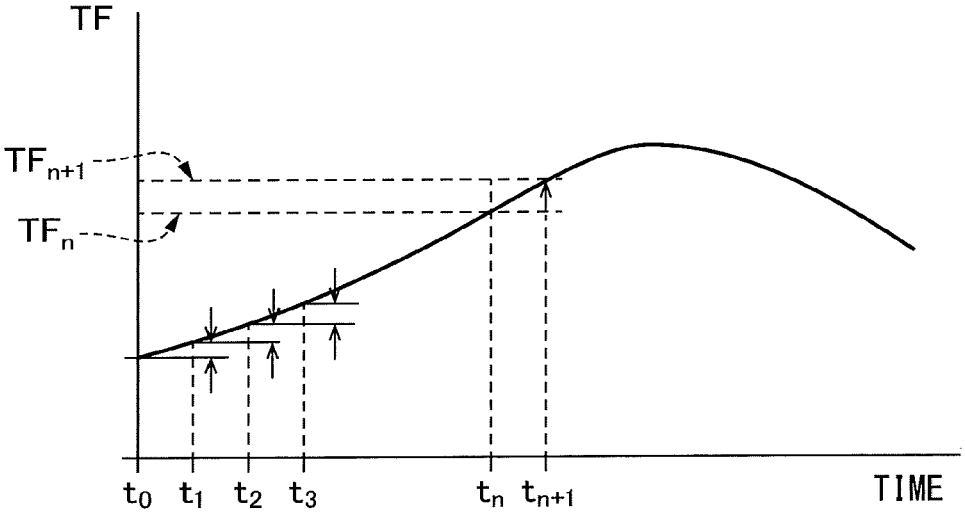
FIG. 7 is a view showing changes in a fuel temperature TF.

First, referring to FIG. 7, the method of estimation of the temperature TF of fuel discharged from the high pressure fuel pump 33 will be explained. Note that, FIG. 7 shows the change along with time of the temperature TF of fuel discharged from the high pressure fuel pump 33. In FIG. 7, if focusing on the time $t_n$ and the time $t_{n+1}$, it is possible to estimate the amount of rise of temperature $(TF_{n+1}-TF_n)$ of the temperature TF of fuel discharged from the high pressure fuel pump 33 within a fixed time period $(t_{n+1}-t_n)$ from the state of the engine at the time $t_n$. That is, if the state of the engine is determined, the amount of heat generated by the heat generating factors making the temperature TF of fuel discharged from the high pressure fuel pump 33 rise, the amount of heating of the heating factors making the temperature TF of fuel discharged from the high pressure fuel pump 33 rise, the amount of cooling of the cooling factors making the temperature TF of fuel discharged from the high pressure fuel pump 33 fall, and the amount of radiation of the heat radiating factors making the temperature TF of fuel discharged from the high pressure fuel pump 33 fall are determined, so the amount of rise of temperature $(TF_{n+1}-TF_n)$ of the temperature TF of fuel discharged from the high pressure fuel pump 33 can be estimated from the state of the engine at the time $t_n$. Stated another way, it becomes possible to estimate the temperature $TF_{n+1}$ of fuel discharged from the high pressure fuel pump 33 after the fixed time period $(t_{n+1}-t_n)$ from the state of the engine at the time $t_n$ $(TF=TF_n)$.

Figure 8:
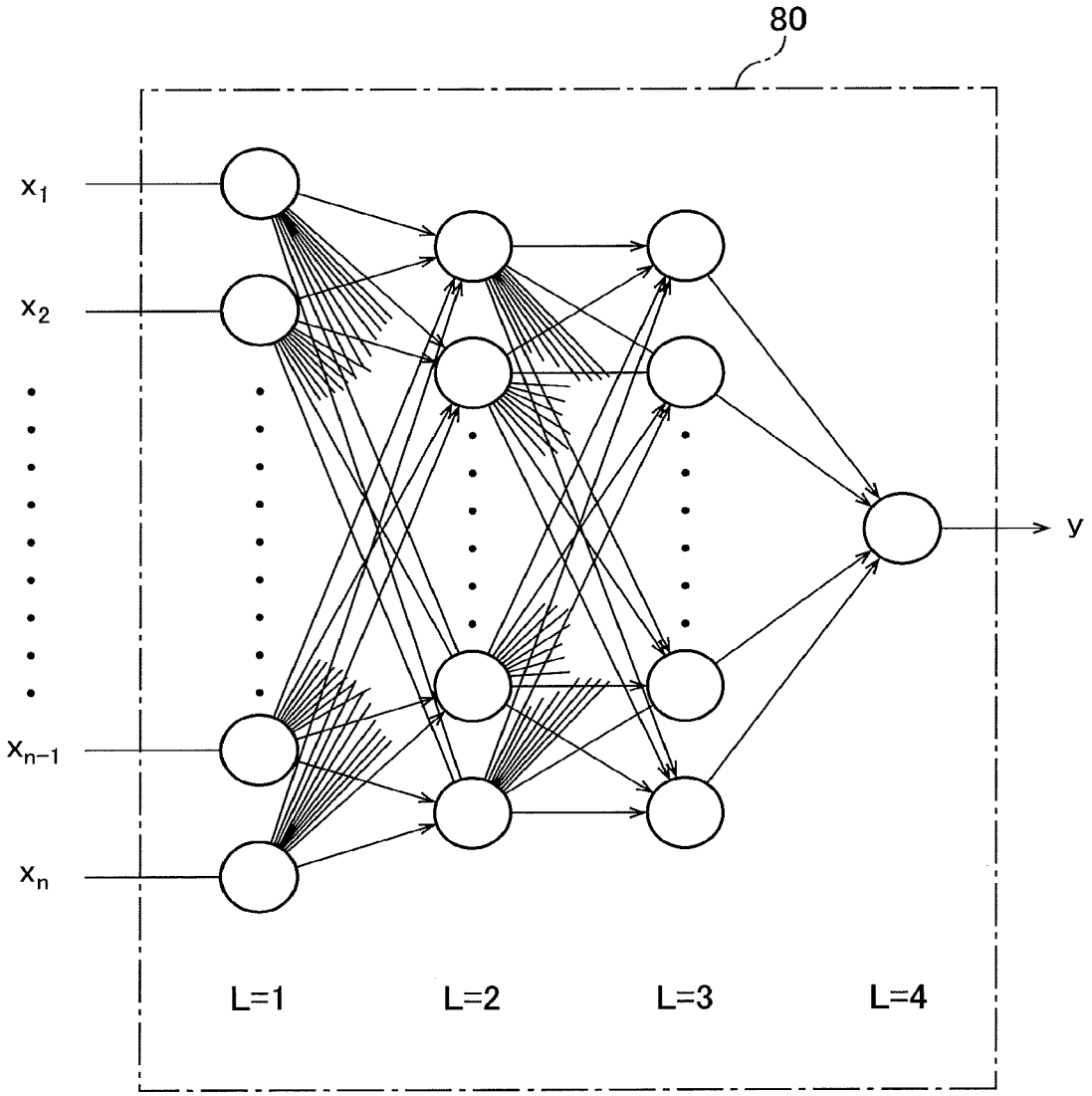
FIG. 8 is a view showing a neural network used in an embodiment according to the present invention.

In this case, in the embodiment according to the present invention, the neural network is used to estimate the temperature $TF_{n+1}$ of fuel discharged from the high pressure fuel pump 33 after the fixed time period $(t_{n+1}-t_n)$ from the state of the engine at the time $t_n$ $(TF=TF_n)$. To estimate the temperature $TF_{n+1}$ of fuel discharged from the high pressure fuel pump 33 after the fixed time period $(t_{n+1}-t_n)$ from the state of the engine at the time $t_n$ $(TF=TF_n)$, a model for estimation of the temperature TF of fuel discharged from the high pressure fuel pump 33 is prepared. Therefore, first, a neural network used for preparing the model for estimation of the temperature of fuel discharged from this high pressure fuel pump 33 will be explained while referring to FIG. 8. If referring to FIG. 8, in this neural network 80 as well, in the same way as the neural network shown in FIG. 6, L=1 shows an input layer, L=2 and L=3 show hidden layers, and L=4 shows an output layer. As shown in FIG. 8, the input layer (L=1) includes "n" number of nodes. "n" number of input values $x_1$, $x_2$, . . . $x_{n-1}$, $x_n$ are input to the nodes of the input layer (L=1). On the other hand, FIG. 8 describes the hidden layer (L=2) and hidden layer (L=3), but the number of these hidden layers may be one or any other number. Further, the numbers of nodes of these hidden layers may also be made any numbers. Note that, the number of nodes of the output layer (L=4) is made "1" and the output value from the node of the output layer is shown by "y". In this case, the output value "y" is the estimated value of the temperature TF of fuel discharged from the high pressure fuel pump 33.

Next, the input values $x_1, x_2 \ldots x_{n-1}, x_n$ in FIG. 8 will be explained while referring to the list shown in FIG. 9. Now then, as explained above, if the state of the engine is determined, the amount of heat generated by the heat generating factors making the temperature TF of fuel discharged from the high pressure fuel pump 33 rise, the amount of heating of the heating factors making the temperature TF of fuel discharged from the high pressure fuel pump 33 rise, the amount of cooling of the cooling factors making the temperature TF of fuel discharged from the high pressure fuel pump 33 fall, and the amount of radiation of heat of the heat radiating factors making the temperature TF of fuel discharged from the high pressure fuel pump 33 fall are determined. Therefore, it is possible to estimate the amount of temperature rise ($TF_{n+1}-TF_n$) of the temperature TF of fuel discharged from the high pressure fuel pump 33, that is, the temperature $TF_{n+1}$ of fuel discharged from the high pressure fuel pump 33 after the fixed time period ($t_{n+1}-t_n$), from the state of the engine at the time $t_n$.

FIG. 9 lists the input parameters to the neural network forming these heat generating factors, heating factors, cooling factors and heat radiating factors. Further, FIG. 9 lists the input parameters strongly affecting changes in the temperature TF of fuel discharged from the high pressure fuel pump 33 as essential input parameters and lists input parameters affecting changes in the temperature TF of fuel discharged from the high pressure fuel pump 33, though not to the extent of essential input parameters, as auxiliary input parameters. As will be understood from FIG. 9, the engine speed, engine load, lubrication oil temperature, amount of fuel supplied to the high pressure fuel pump 33, intake air temperature, vehicle speed, and temperature TF of fuel discharged from the high pressure fuel pump 33 are considered essential input parameters. Among these essential input parameters, the engine speed is a heat generating factor, the engine speed, engine load, and lubrication oil temperature are heating factors, the amount of fuel supplied to the high pressure fuel pump 33 is a cooling factor, and the intake air temperature and vehicle speed are heat radiating factors.

If the engine speed becomes higher, the frequency of pressurizing work by the pump plunger 70 inside the high pressure fuel pump 33 increases and, as a result, the temperature TF of fuel discharged from the high pressure fuel pump 33 becomes higher. Therefore, the engine speed becomes a heat generating factor of fuel discharged from the high pressure fuel pump 33. Further, the higher the engine speed becomes, the more the amount of heat generated by the engine increases, so the greater the amount of heating of the high pressure fuel pump 33 becomes. In addition, the higher the engine load becomes, the more the amount of heat generated by the engine increases, so the greater the amount of heating of the high pressure fuel pump 33 becomes. Furthermore, the high pressure fuel pump 33 is supplied with lubrication oil, so the higher the lubrication oil temperature becomes, the greater the amount of heating of the high pressure fuel pump 33 becomes. Therefore, the engine speed, engine load, and lubrication oil temperature become heating factors of fuel discharged from the high pressure fuel pump 33.

Further, it goes without saying that the temperature TF of fuel discharged from the high pressure fuel pump 33 is an essential input parameter. In one embodiment according to the present invention, the values of only these essential input parameters are made the input values $x_1, x_2 \ldots x_{n-1}, x_n$ in FIG. 8.

On the other hand, as shown in FIG. 9, the ignition timing, EGR rate, opening/closing timing of the intake valve 6, engine cooling water temperature, operation of the air-conditioner 29, electric cooling fan 28, and weather information are made auxiliary input parameters. These ignition timing, EGR rate, opening/closing timing of the intake valve 6, engine cooling water temperature, and operation of the air-conditioner 29 are heat generating factors while the electric cooling fan 28 is a cooling factor. That is, if the ignition timing is advanced, the combustion temperature rises, while if the EGR rate rises, the combustion temperature falls. Further, if the opening timing of the intake valve 6 is advanced and the duration of valve overlap where both the intake valve 6 and exhaust valve 9 are opened becomes longer, the amount of exhaust gas blown back from the exhaust port 11 to inside the combustion chamber 5 increases and as a result the combustion temperature falls.

Further, if the engine cooling water temperature falls, the combustion temperature falls. On the other hand, in the air-conditioner 29, the heat of the engine cooling water temperature sent from the engine body 1 is utilized for the heating or dehumidification. Therefore, if the air-conditioner 29 is operated, the engine cooling water temperature falls and the combustion temperature falls. In this way, the ignition timing, EGR rate, opening/closing timing of the intake valve 6, engine cooling water temperature, and operating state of the air-conditioner 29 affect the combustion temperature, so these ignition timing, EGR rate, opening/closing timing of the intake valve 6, engine cooling water temperature, and operating state of the air-conditioner 29 become heat generating factors. On the other hand, if the electric cooling fan 28 is driven, outside air is made to circulate around the engine body 1 by the electric cooling fan 28, so the high pressure fuel pump 33 is cooled. Therefore, the driven state of the electric cooling fan 28 becomes a cooling factor.

On the other hand, regarding the weather, sometimes it becomes a heating factor and sometimes it becomes a cooling factor. For example, when the air temperature is high and the skies are clear, it becomes a heating factor while when it is raining or snowing, it becomes a cooling factor. In this regard, as explained above, it is also possible use the values of just the essential input parameters as the input values $x_1, x_2 \ldots x_{n-1}, x_n$ in FIG. 8. Of course, in addition to the values of the essential input parameters, the values of the auxiliary input parameters can be made the input values $x_1, x_2 \ldots x_{n-1}, x_n$ at FIG. 8. Note that, below, the case where, in addition to the values of the essential input parameters, the values of the auxiliary input parameters are also made the input values $x_1, x_2 \ldots x_{n-1}, x_n$ in FIG. 8 will be used as an example to explain the embodiments of the present invention.

FIG. 10 shows training data sets prepared using the input values $x_1, x_2 \ldots x_{n-1}, x_n$ and the training data yt. In this FIG. 10, the input values $x_1, x_2 \ldots x_{n-1}, x_n$ respectively show the engine speed, engine load, lubrication oil temperature, amount of fuel supplied to the high pressure fuel pump 33, intake air temperature, vehicle speed, temperature TF of fuel discharged from the high pressure fuel pump 33, ignition timing, EGR rate, opening/closing timing of the intake valve 6, engine cooling water temperature, operating state of the air-conditioner 29, driven state of the electric cooling fan 28, and weather information. In this case, the engine speed is calculated inside the electronic control unit 30. As the engine load, the amount of air taken into the engine calculated by the intake air amount detector 19 is used. Therefore, the engine load is detected by the intake air amount detector 19.

Further, the lubrication oil temperature is detected by the lubrication oil temperature sensor 43, while the amount of fuel supplied to the high pressure fuel pump 33 is, for example, calculated from the amount of fuel discharged from the low pressure fuel pump 32, for example, the electric power driving the low pressure fuel pump 32. Further, the intake air temperature is detected by the intake air temperature sensor 40 while the vehicle speed is detected by the vehicle speed sensor 63. Further, the ignition timing, EGR rate, and opening/closing timing of the intake valve 6 are calculated inside the electronic control unit 30 while the engine cooling water temperature is detected by the water temperature sensor 42. The operating state of the air-conditioner 29 is discerned from the operating commands found inside the electronic control unit 30. For example, when an operating command of the air-conditioner 29 is not issued, the indicator showing the operating state of the air-conditioner 29 is made zero, while when an operating command is issued, the indicator showing the operating state of the air-conditioner 29 is made "1".

On the other hand, the driven state of the electric cooling fan 28 is discerned from the driven commands found in the electronic control unit 30. When no drive command is issued for the electric cooling fan 28, for example, the indicator showing the driven state of the electric cooling fan 28 is set to zero, while when a drive command is issued, the indicator showing the driven state of the electric cooling fan 28 is set to "1". Further, when the input value for the weather information received by the receiving device 64 is, for example, clear skies and a temperature of a certain temperature of more, the indicator showing the weather condition is made zero, when it is clear skies and a temperature of a certain temperature or less, the indicator showing the weather condition is made "1", when it is rain, the indicator showing the weather condition is made "2", and when it is snow, the indicator showing the weather condition is made "3".

On the other hand, if explained using the times $t_n$ and $t_{n+1}$ in FIG. 7, the input values $x_1, x_2 \ldots x_{n-1}, x_n$ in FIG. 10 show the input values at the times $t_n$, while the training data yt in FIG. 10 shows the actually measured value of the temperature TF of fuel discharged from the high pressure fuel pump 33 after the fixed time period $(t_{n+1}-t_n)$. As shown in FIG. 10, in this training data set, "m" number of data expressing the relationship between the input values $x_1, x_2 \ldots x_{n-1}, x_n$ and the training data yt are acquired. For example, the second data (No. 2) lists the acquired input values $x_{12}, x_{22} \ldots x_{m-12}$, $x_{m2}$ and the training data $yt_2$, while the m−1-th data (No. m−1) lists the input values $x_{1m-1}, x_{2m-1} \ldots x_{n-1m-1}, x_{nm-1}$ of the acquired input parameters and the training data $yt_{m-1}$.

Figure 11A:
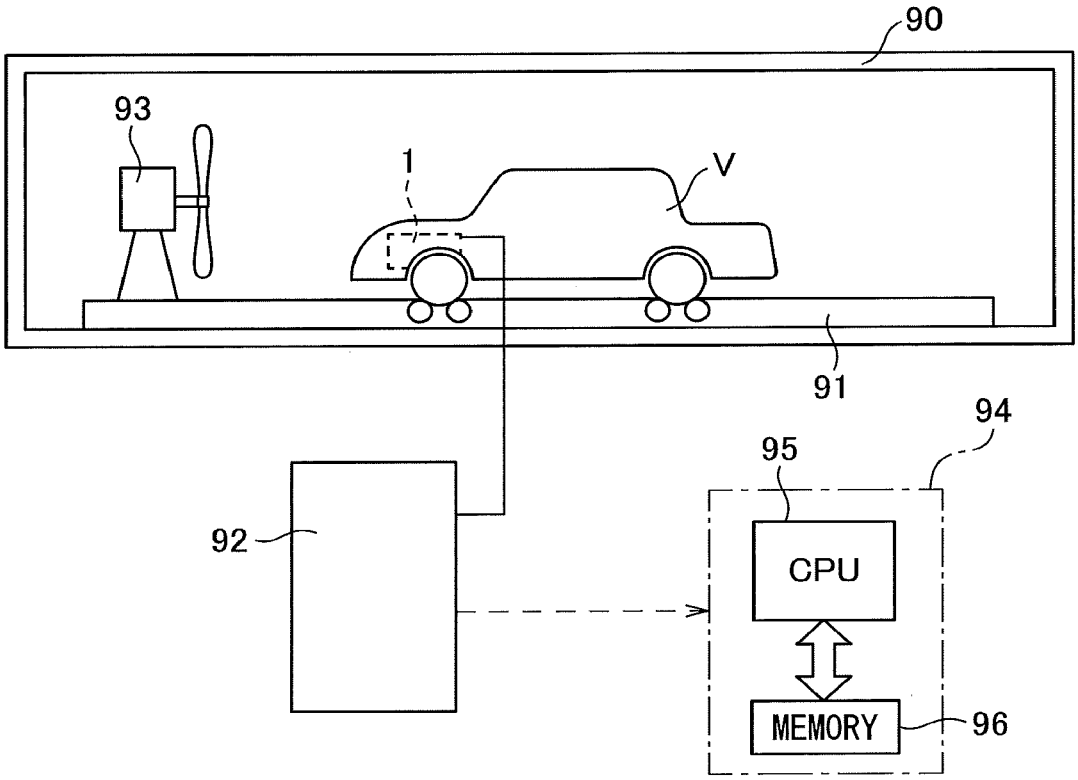
FIGS. 11A and 11B are views for explaining a learning method.
Figure 11B:
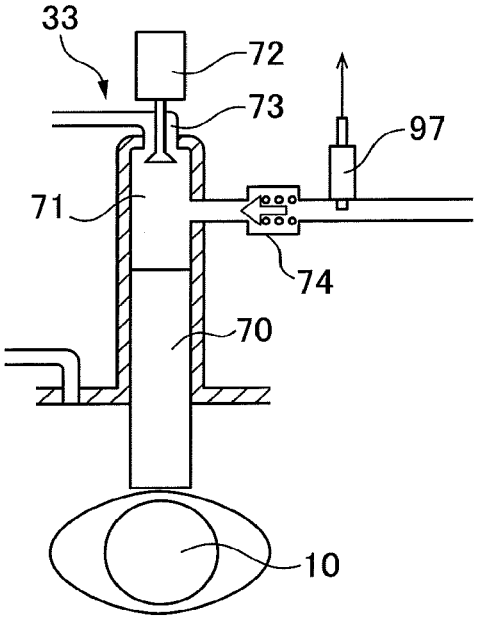

Next, the method of preparation of a training data set shown in FIG. 10 will be explained. FIG. 11A and FIG. 11B show one example of the method of preparation of the training data set. Referring to FIG. 11A, a vehicle V provided with the engine body 1 shown in FIG. 1 is set on a chassis platform 91 inside a test chamber 90 able to realize various meteorological conditions. Using the test apparatus 92, pseudo driving of the vehicle V is performed on the chassis platform 91. The driving wind when the pseudo driving of the vehicle V is performed is given by a blower 93. Further, in the vehicle shown in FIG. 11A, in addition to all of the sensors shown in FIG. 1, a fuel temperature sensor 97 for preparation of the training data set is, as shown in FIG. 11B, attached inside the high pressure fuel pump 33 at a position shown by the arrow 75 in FIG. 3. Due to this fuel temperature sensor 97, the temperature TF of fuel discharged from the high pressure fuel pump 33 is detected.

In the pseudo driving of the vehicle V performed by this test apparatus 92, the weather is, for example, successively changed to the four states of clear skies and an air temperature of a certain temperature or more, clear skies and an air temperature of a certain temperature or less, rain, and snow. At each changed weather condition, the combination of the engine speed, engine load, intake air temperature, vehicle speed, ignition timing, EGR rate, opening/closing timing of the intake valve 6, operating state of the air-conditioner 29, and driven state of the electric cooling fan 28 is successively changed while repeatedly performing pseudo driving of the vehicle V. That is, the combination of the operating parameters of the engine speed, engine load, intake air temperature, vehicle speed, ignition timing, EGR rate, opening/closing timing of the intake valve 6, operating state of the air-conditioner 29, driven state of the electric cooling fan 28, and weather conditions is successively changed while pseudo driving of the vehicle V is being repeatedly performed. Note that, when pseudo driving of the vehicle V is being repeatedly performed, as will be understood from FIG. 4, sometimes cylinder injection is performed and sometimes port injection is performed.

While this pseudo driving is being performed, the data required for preparing a training data set is acquired. That is, if the combination of operating parameters is changed, pseudo driving is performed under the changed combination of operating parameters. While this pseudo driving is being performed, the engine speed, engine load, lubrication oil temperature, amount of fuel supplied to the high pressure fuel pump 33, intake air temperature, vehicle speed, temperature TF of fuel discharged from the high pressure fuel pump 33, ignition timing, EGR rate, the opening/closing timing of the intake valve 6, actually measured value of the engine cooling water temperature, indicator showing the operating state of the air-conditioner 29, indicator showing the driven state of the electric cooling fan 28, and indicator showing the weather condition at every fixed time period such as shown by the times $t_n$(n=0, 1, 2 . . . ) in FIG. 7, are stored, for example, in the test apparatus 92.

Figure 12:
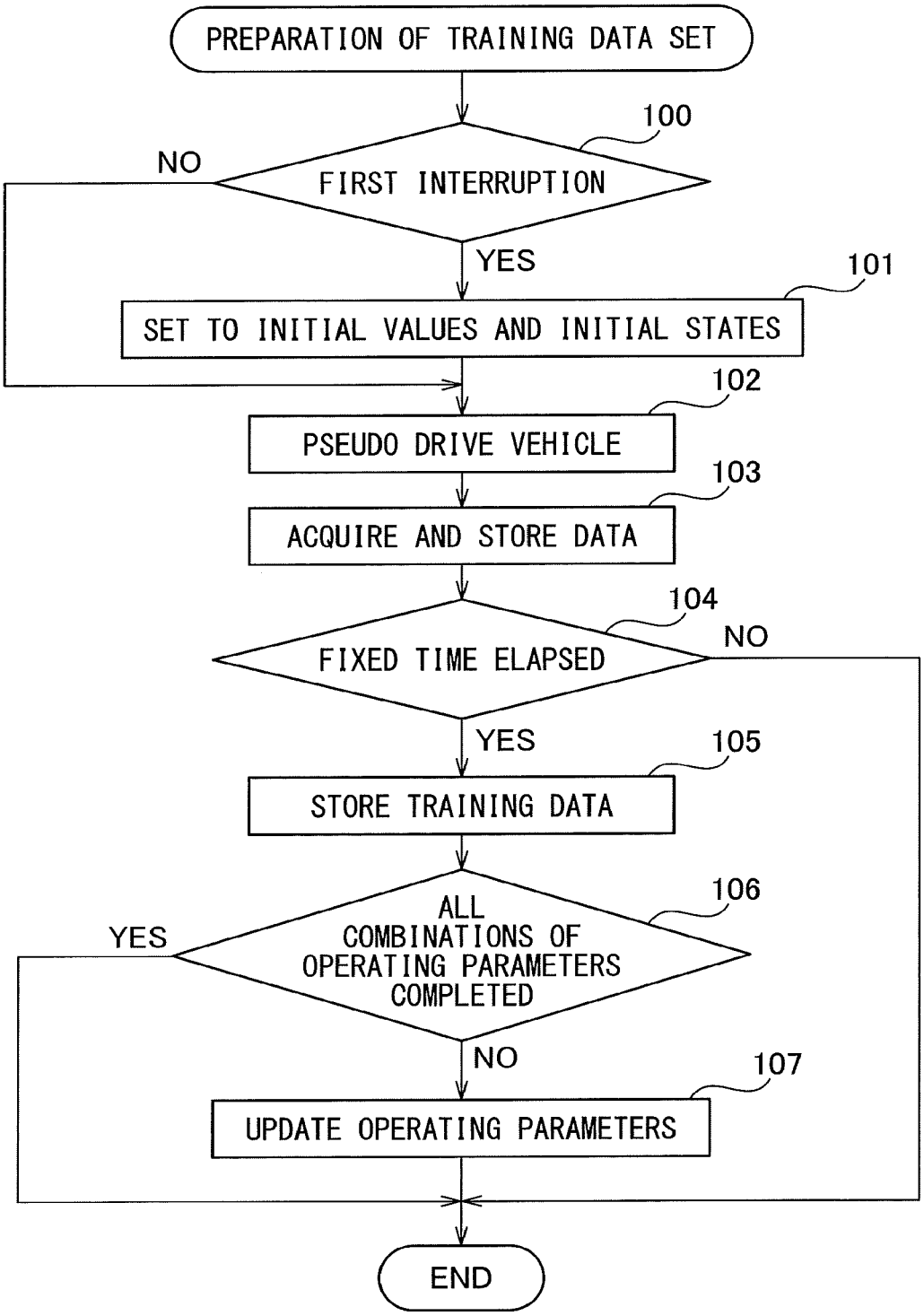
FIG. 12 is a flow chart for preparing a training data set.

FIG. 12 shows a routine for preparation of a training data set performed inside the test apparatus 92. This routine is executed by interruption every fixed time period, for example, every second. Referring to FIG. 12, first, at step 100, it is judged if this is the first interruption. When the first interruption, the routine proceeds to step 101 where the values or states of the operating parameters of the engine speed, engine load, intake air temperature, vehicle speed, ignition timing, EGR rate, opening/closing timing of the intake valve 6, operating state of the air-conditioner 29, driven state of the electric cooling fan 28, and weather condition are set to predetermined initial values or predetermined initial states. Next, at step 102, the vehicle V is pseudo driven by the set values or states of the operating parameters. Next, at step 103, the engine speed, the engine load, the actually measured value of the lubrication oil temperature, the amount of fuel supplied to the high pressure fuel pump 33, the actually measured value of the intake air temperature, the vehicle speed, the actually measured value of the temperature TF of fuel discharged from the high pressure fuel pump 33, the ignition timing, the EGR rate, the opening/closing timing of the intake valve 6, the actually measured value of the engine cooling water temperature, the indicator showing the operating state of the air-conditioner 29, the indicator showing the driven state of the electric cooling fan 28, and the indicator showing the weather condition are acquired as data at the time $t_n$. These data are stored in the memory of the test apparatus 92.

Next, at step 104, it is judged if a predetermined fixed time period, for example, 10 seconds, has elapsed. When the predetermined fixed time period has not elapsed, the processing cycle ends. At the next processing cycle, the routine jumps from step 100 to step 102. At this time, at step 102, the engine speed, the engine load, the actually measured value of the lubrication oil temperature, the amount of fuel supplied to the high pressure fuel pump 33, the actually measured value of the intake air temperature, the vehicle speed, the actually measured value of the temperature TF of fuel discharged from the high pressure fuel pump 33, the ignition timing, the EGR rate, the opening/closing timing of the intake valve 6, the actually measured value of the engine cooling water temperature, the indicator expressing the operating state of the air-conditioner 29, the indicator expressing the driven state of the electric cooling fan 28, and the indicator expressing the weather conditions at this time are acquired as data at the time $t_{n+1}$. These data are stored in the memory of the test apparatus 92. These data at $t_n$, $t_{n+1}$, $t_{n+2}$, $t_{n+3}$, $t_{n+4}$ . . . at the times of the interrupt times are stored in the memory of the test apparatus 92 until a preset certain time period elapses.

Next, when at step 104 it is judged that the predetermined fixed time period has elapsed, the routine proceeds to step 105. At step 105, based on the data stored at step 103, first, the work of combining the data, in which the engine speed, the engine load, the actually measured value of the lubrication oil temperature, the amount of fuel supplied to the high pressure fuel pump 33, the actually measured value of the intake air temperature, vehicle speed, the actually measured value of the temperature TF of fuel discharged from the high pressure fuel pump 33, the ignition timing, the EGR rate, the opening/closing timing of the intake valve 6, the actually measured value of the engine cooling water temperature, the indicator showing the operating state of the air-conditioner 29, the indicator showing the driven state of the electric cooling fan 28, and the indicator showing the weather condition at the time $t_n$ are used as the input values $x_1$, $x_2$ . . . $x_{n-1}$, $x_n$, and the actually measured value of the temperature TF of fuel discharged from the high pressure fuel pump 33 at the time $t_{n-1}$ is used as the training data yt, is performed. Next, this data combining work is performed for all data for each time $t_n$, $t_{n+1}$, $t_{n+2}$, $t_{n+3}$, $t_{n+4}$ . . . . The combinations of data are stored as training data in the memory of the test apparatus 92.

Next, at step 106, it is judged if all combinations of the operating parameters including the engine speed, engine load, intake air temperature, vehicle speed, ignition timing, EGR rate, opening/closing timing of the intake valve 6, operating state of the air-conditioner 29, driven state of the electric cooling fan 28, and weather condition have been completed. If it is judged that all combinations of these operating parameters have not been completed, the routine proceeds to step 107 where the operating parameters are updated. If the operating parameters are updated, at step 102, the vehicle V is pseudo driven by the updated operating parameters, and at step 103, updated new data is acquired and stored. This updating action of the operating parameters is performed until all combinations of the operating parameters are completed. In this way, the No. 1 to No. "m" input values $x_{1m}$, $x_{2m}$ . . . $x_{nm-1}$, $x_{nm}$ and training data $yt_m$(m=1, 2, 3 . . . m) of the training data set shown in FIG. 10 are stored in the memory of the test apparatus 92.

If the training data set is prepared in this way, the learning of the weights of the neural network 80 shown in FIG. 8 is performed by using the electronic data of this training data set. In the example shown in FIG. 11A, a learning apparatus 94 for learning the weights of the neural network is provided. As this learning apparatus 94, a PC can also be used. As shown in FIG. 11A, this learning apparatus 94 is provided with a CPU (microprocessor) 95 and a storage device 96, that is, memory 96. In the example shown in FIG. 11A, the numbers of nodes of the neural network 80 shown in FIG. 8 and the electronic data of the training data set prepared are stored in the memory 96 of the learning apparatus 94. In the CPU 95, the weights of the neural network 80 are learned.

Figure 13:
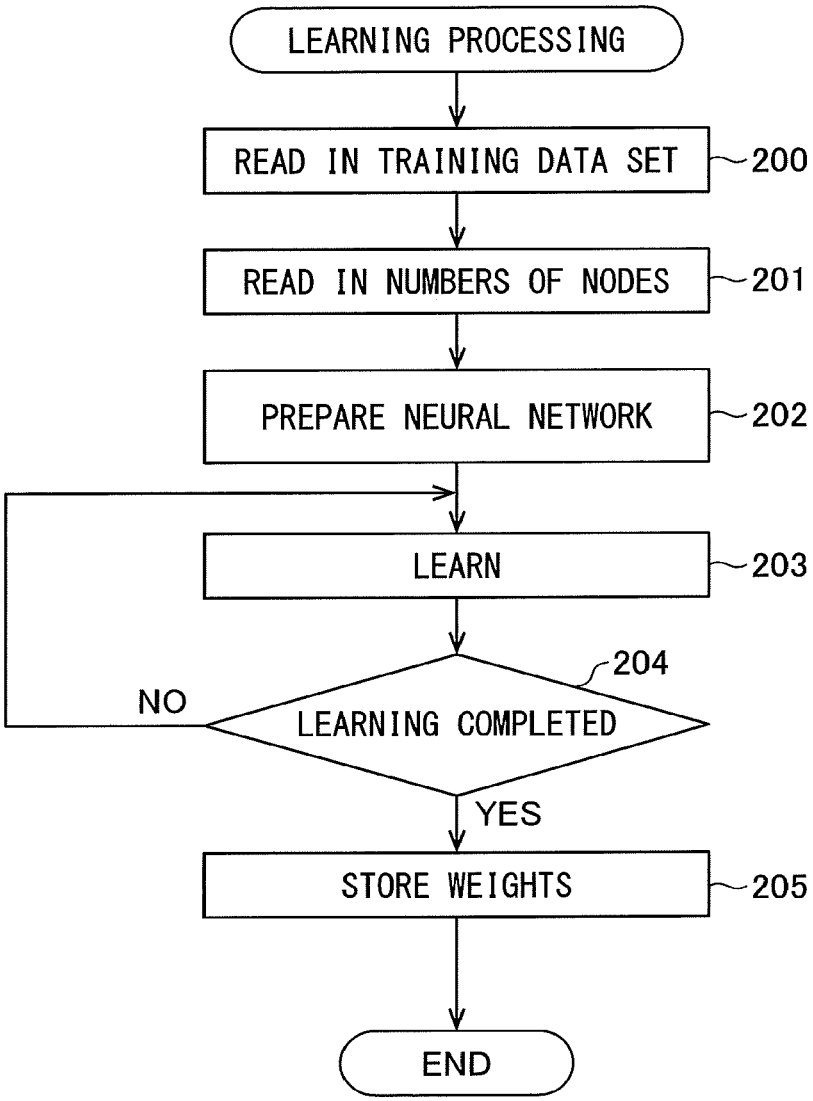
FIG. 13 is a flow chart for performing learning processing.

FIG. 13 shows a routine for learning of weights of the neural network 80 performed at the learning apparatus 94. Referring to FIG. 13, first, at step 200, data of the training data set for the neural network 80 stored in the memory 96 of the learning apparatus 94 is read in. Next, at step 201, the number of nodes of the input layer (L=1) of the neural network 80, the numbers of nodes of the hidden layer (L=2) and hidden layer (L=3), and the number of nodes of the output layer (L=4) are read in. Next, at step 202, the neural network 80 such as shown in FIG. 8 is prepared based on these numbers of nodes.

Next, at step 203, the weights of the neural network 80 are learned. At this step 203, first, the first (No. 1) input values $x_1$, $x_2$ . . . $x_{n-1}$, $x_n$ of FIG. 10 are input to the nodes of the input layer (L=1) of the neural network 80. At this time, from the output layer of the neural network 80, an output value "y" showing the estimated value of the temperature TF of fuel discharged from the high pressure fuel pump 33 after the fixed time period ($t_{n+1}-t_n$ in FIG. 7) is output. If the output value "y" is output from the output layer of the neural network 80, the error sum of squares $E=\frac{1}{2}(y-y_{t1})^2$ between this output value "y" and the first (no. 1) training data $yt_1$ is calculated. The above-mentioned error backpropagation method is used to learn the weights of the neural network 80 so that this error sum of squares E becomes smaller.

If the weights of the neural network 80 finish being learned based on the 1st (no. 1) data of FIG. 10, next the weights of the neural network 80 are learned based on the 2nd (no. 2) data of FIG. 10 using the error backpropagation method. Similarly, the weights of the neural network 80 are similarly learned successively up to the m-th (no. m) data of FIG. 10. When the weights of the neural network 80 finish being learned for all of the 1st (no. 1) to m-th (no. m) data of FIG. 10, the routine proceeds to step 204.

At step 204, for example, the error sum of squares E between all of the output values "y" of the neural network 80 from the first (no. 1) to the m-th (no. m) of FIG. 10 and the training data yt is calculated and it is judged if this error sum of squares E became a preset set error or less. When it is judged that the error sum of squares E does not become a preset set error or less, the routine returns to step 203 where the weights of the neural network 80 are learned again based on the training data set shown in FIG. 10. Next, the weights of the neural network 80 continue to be learned until the error sum of squares E becomes a preset set error or less. When at step 204 it is judged that the error sum of squares E has become the preset set error or less, the routine proceeds to step 205 where the learned weights of the neural network 80 are stored in the memory 96 of the learning apparatus 94. In this way, a model for estimation of the temperature TF of fuel discharged from the high pressure fuel pump 33 is prepared.

Figure 14:
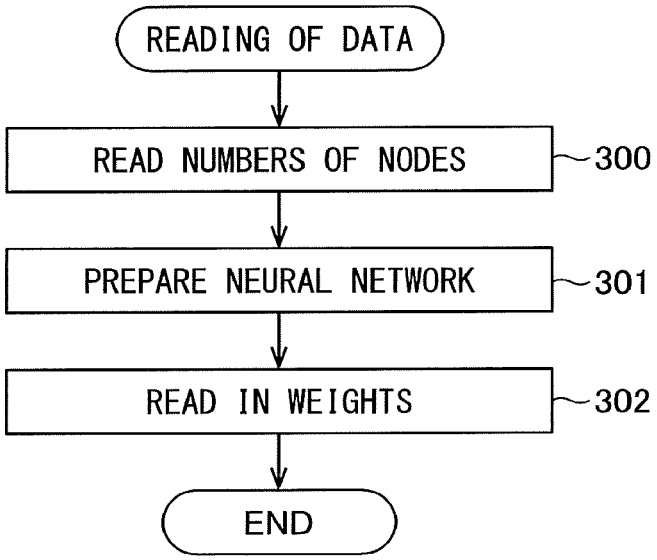
FIG. 14 is a flow chart for reading data into an electronic control unit.

In the embodiment according to the present invention, such a prepared model for estimation of the temperature TF of fuel discharged from the high pressure fuel pump 33 is used to control the high pressure fuel pump 33 at the commercially available vehicle. For this, the model for estimation of the temperature TF of fuel discharged from the high pressure fuel pump 33 is stored in the electronic control unit 50 of the commercially available vehicle. FIG. 14 shows the routine for reading data into the electronic control unit performed at the electronic control unit 50 for storing the model for estimation of the temperature TF of fuel discharged from the high pressure fuel pump 33 in the electronic control unit 50 of the commercially available vehicle.

Referring to FIG. 14, first, at step 300, the number of nodes of the input layer (L=1) of the neural network 80 shown in FIG. 8, the numbers of nodes of the hidden layer (L=2) and hidden layer (L=3), and the number of nodes of the output layer (L=4) are read into the memory 52 of the electronic control unit 50. Next, at step 301, based on these numbers of nodes, the neural network 80 such as shown in FIG. 8 is prepared. Next, at step 302, the learned weights of the neural network 80 are read into the memory 52 of the electronic control unit 50. Due to this, the model for estimation of the temperature TF of fuel discharged from the high pressure fuel pump 33 is stored in the electronic control unit 50 of a commercially available vehicle.

Figure 15:
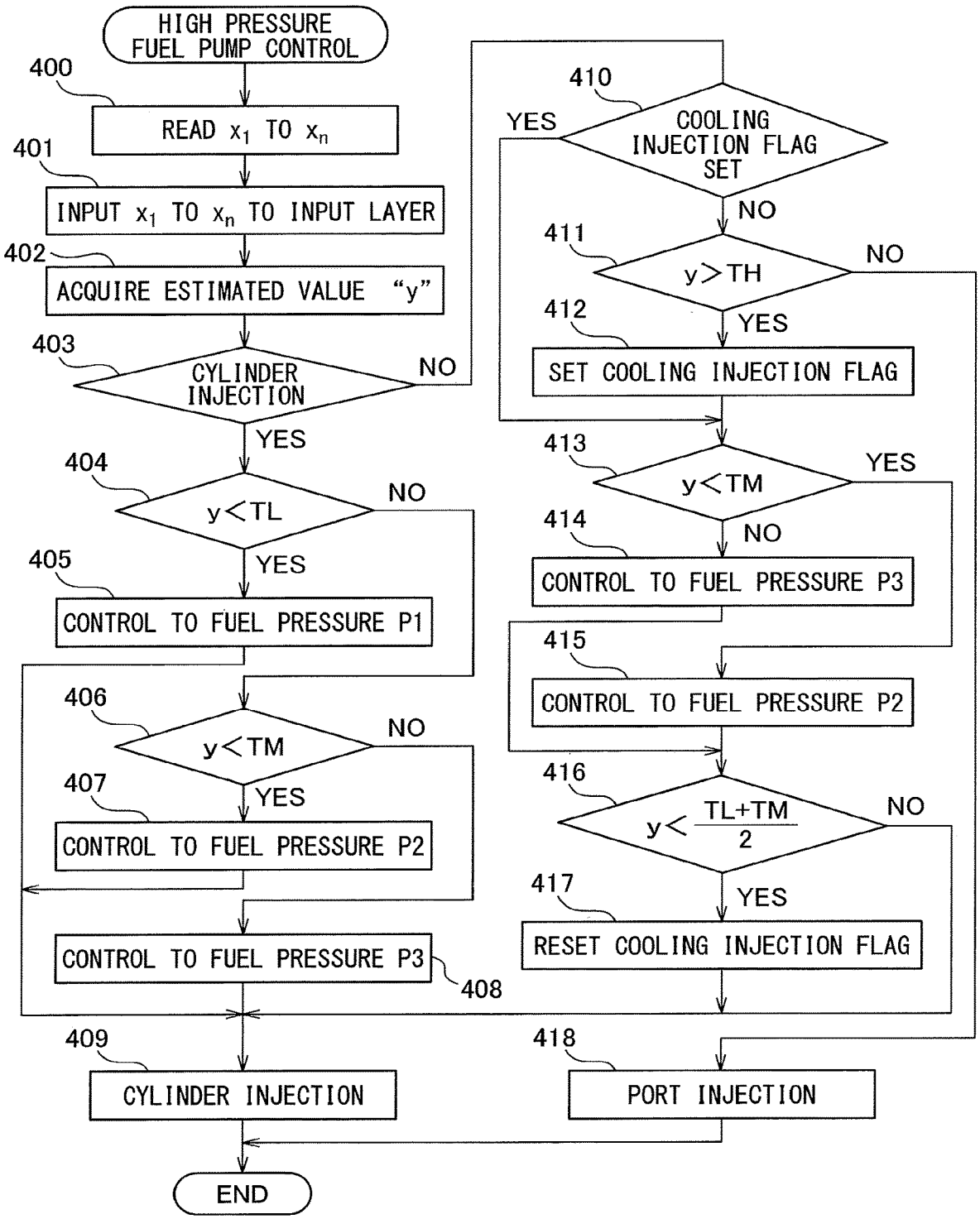
FIG. 15 is a flow chart for controlling a high pressure fuel pump.

FIG. 15 shows a control routine of the high pressure fuel pump 33. This control routine is performed by interruption every fixed time period. Note that, the interruption time period of this control routine is the same time period as the interruption time period of the routine for preparation of the training data set shown in FIG. 12 and for example is made 1 second.

Referring to FIG. 15, first, at step 400, the actually measured value of the engine speed, the actually measured value of the amount of intake air showing the engine load, the actually measured value of the lubrication oil temperature, the amount of fuel supplied to the high pressure fuel pump 33, the actually measured value of the intake air temperature, the actually measured value of the vehicle speed, the temperature TF of fuel discharged from the high pressure fuel pump 33, the ignition timing, the EGR rate, the opening/closing timing of the intake valve 6 and the actually measured value of the engine cooling water temperature, the indicator expressing an operating state of the air-conditioner 29, the indicator expressing a driven state of the electric cooling fan 28, and then indicator expressing the weather conditions, that is, input values $x_1, x_2 \ldots x_{n-1}, x_n$, are read in. Next, at step 401, these input values $x_1, x_2 \ldots x_{n-1}$, x are input to the input layer (L=1) of the neural network 80. At this time, from the neural network 80, the estimated value "y" of the temperature TF of fuel discharged from the high pressure fuel pump 33 after 1 second is output. Due to this, as shown in step 402, the estimated value "y" of the temperature TF of fuel discharged from the high pressure fuel pump 33 is acquired.

In this regard, as explained above, at step 400, as one of the input values, the temperature TF of fuel discharged from the high pressure fuel pump 33 is read in while at step 401, as one of the input values, the temperature TF of fuel discharged from the high pressure fuel pump 33 is input to the input layer of the neural network 80 (L=1). In this case, when the routine first proceeds to step 400 after the control routine shown in FIG. 15 starts to be executed along with the start of operation of the engine, as the initial value showing the temperature TF of fuel discharged from the high pressure fuel pump 33, for example, the actually measured value of the intake air temperature is used. That is, at this time, at step 400, as the temperature TF of fuel discharged from the high pressure fuel pump 33, the actually measured value of the intake air temperature is read in while at step 401, as the temperature TF of fuel discharged from the high pressure fuel pump 33, the actually measured value of the intake air temperature is input to the input layer of the neural network 80 (L=1).

On the other hand, if at step 402 the estimated value "y" of the temperature TF of fuel discharged from the high pressure fuel pump 33 is acquired, at the time of the next interruption, this estimated value "y" of the temperature TF of fuel discharged from the high pressure fuel pump 33 is used as the temperature TF of fuel discharged from the high pressure fuel pump 33. That is, at step 400, as the temperature TF of fuel discharged from the high pressure fuel pump 33, the estimated value "y" of the temperature TF of fuel discharged from the high pressure fuel pump 33 is read in while at step 401, as the temperature TF of fuel discharged from the high pressure fuel pump 33, the estimated value "y" of the temperature TF of fuel discharged from the high pressure fuel pump 33 is input to the input layer of the neural network 80 (L=1).

If at step 402 the estimated value "y" of the temperature TF of fuel discharged from the high pressure fuel pump 33 is acquired, the routine proceeds to step 403 where the target fuel pressure inside the high pressure fuel distribution pipe 30 is controlled based on this acquired estimated value "y" of the temperature TF of fuel discharged from the high pressure fuel pump 33. That is, at step 403, it is judged if the operating state of the engine is in the cylinder injection region shown in FIG. 4. If it is judged that the operating state of the engine is in the cylinder injection region shown in FIG. 4, the routine proceeds to step 404 where it is judged if the estimated value "y" of the temperature TF of fuel discharged from the high pressure fuel pump 33 is lower than the set value TL shown in FIG. 5.

When the estimated value "y" of the temperature TF of fuel discharged from the high pressure fuel pump 33 is lower than the set value TL shown in FIG. 5, the routine proceeds to step 405 where the closing time of the electromagnetic type spill valve 72 of the high pressure fuel pump 33 is controlled so that the fuel pressure inside the high pressure fuel distribution pipe 30 becomes the target fuel pressure P1 shown in FIG. 5. At this time, in the embodiment according to the present invention, the closing time of the electromagnetic type spill valve 72 of the high pressure fuel pump 33 is feedback controlled based on the output signal of the fuel pressure sensor 41 so that the fuel pressure inside the high pressure fuel distribution pipe 30 becomes the target fuel pressure P1. Next, the routine proceeds to step 409 where cylinder injection is performed from the fuel injector 14 under the injection pressure of P1.

On the other hand, when at step 404 it is judged that the estimated value "y" of the temperature TF of fuel discharged from the high pressure fuel pump 33 is not lower than the set value TL shown in FIG. 5, the routine proceeds to step 406 where it is judged if the estimated value "y" of the temperature TF of fuel discharged from the high pressure fuel pump 33 is lower than the set value TM shown in FIG. 5. When the estimated value "y" of the temperature TF of fuel discharged from the high pressure fuel pump 33 is lower than the set value TM, the routine proceeds to step 407 where the closing time of the electromagnetic type spill valve 72 of the high pressure fuel pump 33 is controlled so that the fuel pressure inside the high pressure fuel distribution pipe 30 becomes the target fuel pressure P2 shown in FIG. 5. At this time, in the embodiment of the present invention, the closing time of the electromagnetic type spill valve 72 of the high pressure fuel pump 33 is feedback controlled based on the output signal of the fuel pressure sensor 41 so that the fuel pressure inside the high pressure fuel distribution pipe 30 becomes the target fuel pressure P2. Next, the routine proceeds to step 409 where cylinder injection is performed from the fuel injector 14 under the injection pressure of P2.

On the other hand, when at step 406 it is judged that the estimated value "y" of the temperature TF of fuel discharged from the high pressure fuel pump 33 is not lower than the set value TM shown in FIG. 5, the routine proceeds to step 408 where the closing time of the electromagnetic type spill valve 72 of the high pressure fuel pump 33 is controlled so that the fuel pressure inside the high pressure fuel distribution pipe 30 becomes the target fuel pressure P3 shown in FIG. 5. At this time, in the embodiment according to the present invention, the closing time of the electromagnetic type spill valve 72 of the high pressure fuel pump 33 is feedback controlled based on the output signal of the fuel pressure sensor 41 so that the fuel pressure inside the high pressure fuel distribution pipe 30 becomes the target fuel pressure P3. Next, the routine proceeds to step 409 where cylinder injection is performed from the fuel injector 14 under the injection pressure of P3.

On the other hand, when at step 403 it is judged that the operating state of the engine is not in the cylinder injection region shown in FIG. 4, that is, when the operating state of the engine is in the port injection region shown in FIG. 4, the routine proceeds to step 410 where it is judged if a cooling use injection flag showing that the high pressure fuel pump 33 should be cooled is set. When the cooling use injection flag is not set, the routine proceeds to step 411 where it is judged if the estimated value "y" of the temperature TF of fuel discharged from the high pressure fuel pump 33 is higher than the set value TH shown in FIG. 5. When the estimated value "y" of the temperature TF of fuel discharged from the high pressure fuel pump 33 is not higher than the set value TH, the routine jumps to step 418 where port injection is performed from the fuel injector 13. At this time, the electromagnetic type spill valve 72 of the high pressure fuel pump 33 is held in the open state.

As opposed to this, when it is judged that the estimated value "y" of the temperature TF of fuel discharged from the high pressure fuel pump 33 is higher than the set value TH shown in FIG. 5, the routine proceeds to step 412 where the cooling use injection flag is set, then the routine proceeds to step 413. If the cooling use injection flag is set, at the next processing cycle, the routine jumps from step 410 to step 413. At step 413, it is judged if the estimated value "y" of the temperature TF of fuel discharged from the high pressure fuel pump 33 is lower than the set value TM shown in FIG. 5. When it is judged that the estimated value "y" of the temperature TF of fuel discharged from the high pressure fuel pump 33 is not lower than the set value TM, the routine proceeds to step 414 where the closing time of the electromagnetic type spill valve 72 of the high pressure fuel pump 33 is controlled so that the fuel pressure inside the high pressure fuel distribution pipe 30 becomes the target fuel pressure P3 shown in FIG. 5. At this time, in the embodiment according to the present invention, the closing time of the electromagnetic type spill valve 72 of the high pressure fuel pump 33 is feedback controlled based on the output signal of the fuel pressure sensor 41 so that the fuel pressure inside the high pressure fuel distribution pipe 30 becomes the target fuel pressure P3. Next, the routine proceeds to step 416.

As opposed to this, when it is judged that the estimated value "y" of the temperature TF of fuel discharged from the high pressure fuel pump 33 is lower than the set value TM, the routine proceeds to step 415 where the closing time of the electromagnetic type spill valve 72 of the high pressure fuel pump 33 is controlled so that the fuel pressure inside the high pressure fuel distribution pipe 30 becomes the target fuel pressure P2 shown in FIG. 5. At this time, in the embodiment according to the present invention, the closing time of the electromagnetic type spill valve 72 of the high pressure fuel pump 33 is feedback controlled based on the output signal of the fuel pressure sensor 41 so that the fuel pressure inside the high pressure fuel distribution pipe 30 becomes the target fuel pressure P2. Next, the routine proceeds to step 416.

At step 416, it is judged if the estimated value "y" of the temperature TF of fuel discharged from the high pressure fuel pump 33 becomes lower than, for example, an intermediate value (TL+TM)/2 of the set values TL and TH shown in FIG. 5. When it is judged that the estimated value "y" of the temperature TF of fuel discharged from the high pressure fuel pump 33 does not become lower than (TL+TM)/2, the routine proceeds to step 409. On the other hand, when it is judged that the estimated value "y" of the temperature TF of fuel discharged from the high pressure fuel pump 33 becomes lower than (TL+TM)/2, at step 417, the cooling use injection flag is reset, then the routine proceeds to step 409. At step 409, regardless of the fact that the operating state of the engine is in the port injection region shown in FIG. 4, cylinder injection is performed from the fuel injector 14.

In this way, in the embodiment according to the present invention, in a control device of the high pressure fuel pump 33 for fuel injection driven by an engine to supply fuel to the fuel injector 14, values of at least seven parameters of an engine speed, an engine load, a lubrication oil temperature, an amount of fuel supplied to the high pressure fuel pump 33, a temperature of intake air fed into the engine, a temperature of fuel discharged from the high pressure fuel pump 33, and a vehicle speed are acquired, and a learned neural network learned in weights using acquired values of the seven parameters as input values of the neural network and using as training data a temperature of fuel discharged from the high pressure fuel pump 33 acquired after a fixed time period from when acquiring the values of the seven parameters is stored. At the time of an engine operation, the temperature of fuel discharged from the high pressure fuel pump 33 after the fixed time period is estimated by using the learned neural network from a current engine speed, a current engine load, a current lubrication oil temperature, a current amount of fuel supplied to the high pressure fuel pump 33, a current temperature of intake air fed into the engine, a current temperature of fuel discharged from the high pressure fuel pump 33, and a current vehicle speed. In this case, actually measured values are used for the current engine speed, the current engine load, the current lubrication oil temperature, the current amount of fuel supplied to the high pressure fuel pump 33, the current temperature of intake air fed into the engine, and the current vehicle speed, and an estimated value estimated using the learned neural network is used for the current temperature of fuel discharged from the high pressure fuel pump 33. A pressure of fuel injected from the fuel injector 14 is controlled based on the estimated value of the temperature of the fuel discharged from the high pressure fuel pump 33 after the fixed time period which is estimated using the learned neural network.

In this case, in another embodiment according to the present invention, in addition to the values of the above-mentioned seven parameters, the ignition timing, EGR rate, opening timing of the intake valve, and engine cooling water temperature are used as input values of the neural network. Further, in still another embodiment according to the present invention, an indicator expressing an operating state of an electric cooling fan, and an indicator expressing a weather condition are further made the input values of the neural network.

The invention claimed is:

1. A control device for a high pressure fuel pump for fuel injection driven by an engine to supply fuel to a fuel injector, wherein values of at least seven parameters of an engine speed, an engine load, a lubrication oil temperature, an amount of fuel supplied to the high pressure fuel pump, a temperature of intake air fed into the engine, a temperature of fuel discharged from the high pressure fuel pump, and a vehicle speed are acquired, a learned neural network learned in weights using acquired values of the seven parameters as input values of the neural network and using as training data a temperature of fuel discharged from the high pressure fuel pump acquired after a fixed time period from when acquiring the values of the seven parameters is stored, at the time of an engine operation, the temperature of fuel discharged from the high pressure fuel pump after the fixed time period is estimated by using the learned neural network from a current engine speed, a current engine load, a current lubrication oil temperature, a current amount of fuel supplied to the high pressure fuel pump, a current temperature of intake air fed into the engine, a current temperature of fuel discharged from the high pressure fuel pump, and a current vehicle speed, wherein actually measured values are used for the current engine speed, the current engine load, the current lubrication oil temperature, the current amount of fuel supplied to the high pressure fuel pump, the current temperature of intake air fed into the engine, and the current vehicle speed and an estimated value estimated using the learned neural network is used for the current temperature of fuel discharged from the high pressure fuel pump and a pressure of fuel injected from the fuel injector is controlled based on the estimated value of the temperature of the fuel discharged from the high pressure fuel pump after the fixed time period which is estimated using the learned neural network.

2. The control device for a high pressure fuel pump for fuel injection according to claim 1, wherein in addition to said values of the seven parameters, an ignition timing, an EGR rate, an opening time of an intake valve, and an engine cooling water temperature are made the input values of the neural network.

3. The control device for a high pressure fuel pump for fuel injection according to claim 2, wherein an indicator expressing an operating state of an air-conditioner, an indicator expressing an operating state of an electric cooling fan, and an indicator expressing a weather condition are further made the input values of the neural network.

* * * * *